US011814707B2

(12) United States Patent
Urata et al.

(10) Patent No.: US 11,814,707 B2
(45) Date of Patent: Nov. 14, 2023

(54) SOFT MAGNETIC POWDER, FE-BASED NANOCRYSTALLINE ALLOY POWDER, MAGNETIC COMPONENT AND DUST CORE

(71) Applicants: TOKIN CORPORATION, Sendai (JP); JFE STEEL CORPORATION, Tokyo (JP)

(72) Inventors: Akiri Urata, Sendai (JP); Miho Chiba, Sendai (JP); Mineo Muraki, Tokyo (JP); Makoto Nakaseko, Tokyo (JP); Takuya Takashita, Tokyo (JP)

(73) Assignees: TOKIN CORPORATION, Sendai (JP); JFE STEEL CORPORATION, Tokyo (JP)

( * ) Notice: Subject to any disclaimer, the term of this patent is extended or adjusted under 35 U.S.C. 154(b) by 221 days.

(21) Appl. No.: 16/481,449

(22) PCT Filed: Jan. 26, 2018

(86) PCT No.: PCT/JP2018/002380
§ 371 (c)(1),
(2) Date: Jul. 26, 2019

(87) PCT Pub. No.: WO2018/139563
PCT Pub. Date: Aug. 2, 2018

(65) Prior Publication Data

US 2019/0362871 A1 Nov. 28, 2019

(30) Foreign Application Priority Data

Jan. 27, 2017 (JP) ..... 2017-012977

(51) Int. Cl.

| | |
|---|---|
| ***C22C 38/00*** | (2006.01) |
| ***C22C 33/02*** | (2006.01) |
| ***C22C 38/02*** | (2006.01) |
| ***C22C 38/06*** | (2006.01) |
| ***C22C 38/14*** | (2006.01) |
| ***C22C 38/16*** | (2006.01) |
| ***C22C 45/02*** | (2006.01) |
| ***H01F 1/147*** | (2006.01) |
| ***B22F 1/08*** | (2022.01) |
| *H01F 1/153* | (2006.01) |

(52) U.S. Cl.
CPC ..... *C22C 38/005* (2013.01); *B22F 1/08* (2022.01); *C22C 33/0257* (2013.01); *C22C 38/02* (2013.01); *C22C 38/06* (2013.01); *C22C 38/14* (2013.01); *C22C 38/16* (2013.01); *C22C 45/02* (2013.01); *H01F 1/14791* (2013.01); *C22C 2200/02* (2013.01); *C22C 2200/04* (2013.01); *C22C 2202/02* (2013.01); *H01F 1/15333* (2013.01)

(58) Field of Classification Search
CPC ..... B22F 2009/048; C22C 2200/02; C22C 2202/02; C22C 38/16; C22C 45/02; C22C 2200/04; C22C 38/02; H01F 1/15308; H01F 1/15333; H01F 27/255; H01F 3/08; H01F 41/0246; H01F 41/0226; C21D 6/00; C21D 8/1211
See application file for complete search history.

(56) References Cited

U.S. PATENT DOCUMENTS

| | | | | |
|---|---|---|---|---|
| 8,177,923 | B2 | 5/2012 | Ohta et al. | |
| 8,182,620 | B2 | 5/2012 | Ohta et al. | |
| 8,277,579 | B2 | 10/2012 | Makino | |
| 8,287,665 | B2 | 10/2012 | Urata et al. | |
| 8,287,666 | B2 | 10/2012 | Ohta et al. | |
| 8,491,731 | B2 | 7/2013 | Makino | |
| 10,984,932 | B2 | 4/2021 | Urata et al. | |
| 2007/0175545 | A1 | 8/2007 | Urata et al. | |
| 2009/0266448 | A1 | 10/2009 | Ohta et al. | |
| 2010/0043927 | A1 | 2/2010 | Makino | |
| 2010/0097171 | A1 | 4/2010 | Urata et al. | |
| 2010/0139814 | A1 | 6/2010 | Makino | |
| 2011/0085931 | A1 | 4/2011 | Ohta et al. | |
| 2011/0108167 | A1 | 5/2011 | Ohta et al. | |
| 2012/0199254 | A1* | 8/2012 | Urata | C21D 6/00 148/579 |
| 2013/0278366 | A1 | 10/2013 | Makino | |
| 2016/0322139 | A1* | 11/2016 | Ye | B22F 1/16 |
| 2017/0162308 | A1 | 6/2017 | Makino et al. | |
| 2017/0320138 | A1* | 11/2017 | Takahashi | C22C 38/00 |
| 2018/0154434 | A1 | 6/2018 | Henmi et al. | |
| 2018/0169759 | A1 | 6/2018 | Nakamura et al. | |

(Continued)

FOREIGN PATENT DOCUMENTS

| | | | |
|---|---|---|---|
| CA | 2990362 | C | 3/2020 |
| CN | 104805382 | A | 7/2015 |
| JP | 2002151317 | A | 5/2002 |

(Continued)

OTHER PUBLICATIONS

Machine translation JP2014005492 (Year: 2014).*
Makino, Akihiro, et al. "FeSiBPCu nanocrystalline soft magnetic alloys with high Bs of 1.9 Tesla produced by crystallizing hetero-amorphous phase." Materials Transactions 50.1 (2009): 204-209. (Year: 2009).*
Larsson, Oskar. "Fe-based amorphous powder for soft-magnetic composites." (2013). (Year: 2013).*
International Search Report (ISR) dated Mar. 20, 2018 (and English translation thereof) issued in International Application No. PCT/JP2018/002380.
Written Opinion of the International Search Authority dated Mar. 20, 2018 issued in International Application No. PCT/JP2018/002380.
Canadian Office Action dated Oct. 23, 2020 issued in Canadian Application No. 3,051,184.

(Continued)

*Primary Examiner* — Nicholas A Wang
(74) *Attorney, Agent, or Firm* — Holtz, Holtz & Volek PC

(57) ABSTRACT

This soft magnetic powder is represented by composition formula $Fe_aSi_bB_cP_dCu_e$ with the exception of unavoidable impurities. In the composition formula, a, b, c, d and e satisfy $79 \leq a \leq 84.5$ at %, $0 \leq b < 6$ at %, $4 \leq c \leq 10$ at %, $4 < d \leq 11$ at %, $0.2 \leq e < 0.4$ at %, and $a+b+c+d+e=100$ at %.

18 Claims, No Drawings

(56) References Cited

U.S. PATENT DOCUMENTS

| | | | |
|---|---|---|---|
| 2018/0361474 | A9 | 12/2018 | Nakamura et al. |
| 2019/0362871 | A1 | 11/2019 | Urata et al. |

FOREIGN PATENT DOCUMENTS

| | | | | |
|---|---|---|---|---|
| JP | 2007231415 | A | | 9/2007 |
| JP | 4288687 | B2 | | 7/2009 |
| JP | 4310480 | B2 | | 8/2009 |
| JP | 2009174034 | A | | 8/2009 |
| JP | 4514828 | B2 | | 7/2010 |
| JP | 4584350 | B2 | | 11/2010 |
| JP | 4629807 | B1 | | 2/2011 |
| JP | 2011026706 | A | | 2/2011 |
| JP | 2014005492 | A | | 1/2014 |
| JP | 5445888 | B2 | | 3/2014 |
| JP | 2014075529 | A | | 4/2014 |
| JP | 5632608 | B2 | | 11/2014 |
| JP | 5932907 | B2 | | 6/2016 |
| JP | 2016104900 | A | | 6/2016 |
| JP | WO2016121951 | | * | 8/2016 |
| WO | 2008068899 | A1 | | 6/2008 |
| WO | 2009096382 | A1 | | 8/2009 |
| WO | 2016152270 | A1 | | 9/2016 |
| WO | 2017022594 | A1 | | 2/2017 |
| WO | 2017086102 | A1 | | 5/2017 |
| WO | 2017086146 | A1 | | 5/2017 |
| WO | 2018139563 | A1 | | 8/2018 |

OTHER PUBLICATIONS

Korean Office Action (and English language translation thereof) dated Sep. 1, 2020 issued in Korean Application No. 10-2019-7021757.

Canadian Office Action dated Apr. 7, 2021 issued in Canadian Application No. 3051184.

Chinese Office Action (and English language translation thereof) dated Mar. 25, 2021 issued in counterpart Chinese Application No. 201880008431.9.

Indian Office Action dated Mar. 31, 2021 issued in counterpart Indian Application No. 201917030307.

* cited by examiner

SOFT MAGNETIC POWDER, FE-BASED NANOCRYSTALLINE ALLOY POWDER, MAGNETIC COMPONENT AND DUST CORE

TECHNICAL FIELD

This invention relates to a soft magnetic powder which is suitable for use in magnetic components such as a transformer, an inductor and a magnetic core of a motor.

BACKGROUND ART

For example, this type of soft magnetic powder is disclosed in Patent Document 1.

Patent Document 1 discloses an alloy composition comprising Fe, B, Si, P, C and Cu. The alloy composition of Patent Document 1 has a continuous strip shape or a powder shape. The powder-shaped alloy composition (soft magnetic powder) is formed by an atomization method, for example, and has an amorphous phase (non-crystalline phase) as a main phase. This soft magnetic powder is partially crystallized into bccFe (aFe) nanocrystals when heat-treated under a predetermined heat-treatment condition, so that an Fe-based nanocrystalline alloy powder can be obtained. By using the thus-obtained Fe-based nanocrystalline alloy powder, a magnetic component having superior magnetic properties can be obtained.

PRIOR ART DOCUMENT(S)

Patent Document(s)

Patent Document 1: JP 4514828 B

SUMMARY OF INVENTION

Technical Problem

When a soft magnetic powder is used to obtain an Fe-based nanocrystalline alloy powder, from a view point of obtaining an Fe-based nanocrystalline alloy powder having satisfactory magnetic properties, the soft magnetic powder is desired to be substantially consisting of only an amorphous phase (non-crystalline phase), i.e. to have extremely low crystallinity. However, the attempt to obtain a soft magnetic powder having extremely low crystallinity not only requires expensive raw materials but also requires complicated processes such as classification and exclusion of large particles after atomization. Thus, manufacturing cost increases.

It is therefore an object of the present invention to provide a soft magnetic powder which enables manufacture of an Fe-based nanocrystalline alloy powder having satisfactory magnetic properties without increase of manufacturing cost.

Solution to Problem

As a result of diligent study, the inventors of the present invention have obtained a predetermined composition range which is not suitable for a continuous strip but is suitable for a soft magnetic powder. This composition range is not suitable to form a continuous strip since satisfactory uniformity cannot be obtained because of contained crystals. However, in a case where a soft magnetic powder of this range was used to obtain an Fe-based nanocrystalline alloy powder while crystallinity of the soft magnetic powder before heat-treatment was reduced to 10% or less, the obtained Fe-based nanocrystalline alloy powder had satisfactory magnetic properties. Further study has revealed that even in a case where a soft magnetic powder contains a certain amount of nanocrystals (crystal phase), when its crystallinity is 10% or less, an Fe-based nanocrystalline alloy powder after heat-treatment has magnetic properties hardly inferior to those of another Fe-based nanocrystalline alloy powder obtained from another soft magnetic powder having crystallinity of extremely close to zero. The present invention provides a soft magnetic powder described below which has this composition range.

An aspect of the present invention provides a soft magnetic powder represented by composition formula of $Fe_aSi_bB_cP_dCu_e$ except for inevitable impurities, wherein $79 \le a \le 84.5$ at %, $0 \le b < 6$ at %, $4 \le c \le 10$ at %, $4 < d \le 11$ at %, $0.2 \le e < 0.4$ at % and $a+b+c+d+e=100$ at %.

Advantageous Effects of Invention

Since the soft magnetic powder according to the present invention contains Fe, Si, B, P and Cu within the predetermined range, its crystallinity can be reduced to 10% or less. When crystallinity is reduced to 10% or less, an Fe-based nanocrystalline alloy powder having satisfactory magnetic properties can be obtained via heat-treatment similar to that of an existing method. Thus, the present invention provides a soft magnetic powder, which enables manufacture of an Fe-based nanocrystalline alloy powder having satisfactory magnetic properties without increase of manufacturing cost, not by making its crystallinity extremely close to zero but by allowing its crystallinity to be 10% or less.

An appreciation of the objectives of the present invention and a more complete understanding of its structure may be had by studying the following description of the preferred embodiment.

DESCRIPTION OF EMBODIMENTS

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

A soft magnetic powder according to the present embodiment is represented by composition formula of $Fe_aSi_bB_cP_dCu_e$ except for inevitable impurities. In the composition formula of $Fe_aSi_bB_cP_dCu_e$, $79 \le a \le 84.5$ at %, $0 \le b < 6$ at %, $4 \le c \le 10$ at %, $4 < d \le 11$ at %, $0.2 \le e < 0.4$ at % and $a+b+c+d+e=100$ at %.

The soft magnetic powder according to the embodiment of the present invention can be used as a starting material of an Fe-based nanocrystalline alloy powder. The Fe-based nanocrystalline alloy powder made of the soft magnetic powder of the present embodiment can be used as a material for producing various magnetic components and dust cores. In addition, the soft magnetic powder of the present embodiment can be used as a direct material for producing various magnetic components and dust cores.

Hereafter, first, explanation will be mainly made about properties of the soft magnetic powder and the Fe-based nanocrystalline alloy powder of the present embodiment.

The soft magnetic powder of the present embodiment can be formed by a forming method such as an atomization method. The thus-formed soft magnetic powder has an amorphous phase (non-crystalline phase) as a main phase. When this soft magnetic powder is subjected to heat-treatment under a predetermined heat-treatment condition, bccFe (aFe) nanocrystals are crystallized, so that an Fe-based nanocrystalline alloy powder having superior magnetic properties can be obtained. Thus, the Fe-based nanocrystalline alloy powder of the present embodiment is an Fe-base alloy which has an amorphous phase as a main phase while including bccFe nanocrystals.

In general, when a soft magnetic powder having an amorphous phase as a main phase is formed, nano-sized aFe crystals (initial crystals) may be crystallized. These initial crystals may cause degradation of magnetic properties of an Fe-based nanocrystalline alloy powder. In detail, the initial crystals may cause crystallization of nanocrystals each having a particle diameter of more than 50 nm in an Fe-based nanocrystalline alloy powder. Even when a small amount of nanocrystals of a particle diameter of more than 50 nm is crystallized, the domain wall displacement is restricted, and magnetic properties of the Fe-based nanocrystalline alloy powder are degraded. Therefore, it is generally considered to be desirable to form a soft magnetic powder substantially consisting of only an amorphous phase by reducing its initial crystallinity (hereafter, simply referred to as "crystallinity"), which is volume ratio of the initial crystals thereof relative to the soft magnetic powder, as low as possible. However, the attempt to obtain a soft magnetic powder having extremely low crystallinity not only requires expensive raw materials but also requires complicated processes such as classification and exclusion of large particles after atomization. Thus, manufacturing cost increases.

As previously described, the soft magnetic powder having the composition formula of $Fe_aSi_bB_cP_dCu_e$ according to the present embodiment contains Fe of not less than 79 at % but not more than 84.5 at %, Si of less than 6 at % (including zero), B of not less than 4 at % but not more than 10 at %, P of more than 4 at % but not more than 11 at % and Cu of not less than 0.2 at % but less than 0.4 at %. This composition range (hereafter, referred to as "predetermined range") is not suitable to form a continuous strip since satisfactory uniformity cannot be obtained because of contained crystals (initial crystals). In detail, when a continuous strip having the composition range according to the present embodiment is formed, the initial crystals of 10 volume % or less might be contained. In other words, crystallinity might be about 10%. In this case, the continuous strip might be partially brittle because of the initial crystals. In addition, uniform micro organization cannot be obtained even after nanocrystallization, so that magnetic properties might be significantly degraded.

However, the aforementioned problems are specific to a continuous strip. In contrast, a soft magnetic powder has almost no structural problem even when its crystallinity is about 10%. Moreover, if its crystallinity can be reduced to 10% or less, pinning sites of domain wall are reduced. More specifically, in a case where its crystallinity is reduced to 10% or less, crystallization of nanocrystals having a particle diameter of more than 50 nm can be reduced in an Fe-based nanocrystalline alloy powder even under heat-treatment similar to that of an existing method. As a result, the obtained Fe-based nanocrystalline alloy powder has satisfactory magnetic properties hardly inferior to those of another Fe-based nanocrystalline alloy powder obtained from another soft magnetic powder having crystallinity of extremely close to zero.

Since the soft magnetic powder according to the present embodiment contains Fe, Si, B, P and Cu within the predetermined range, its crystallinity can be reduced to 10% or less. When its crystallinity is reduced to 10% or less, the Fe-based nanocrystalline alloy powder having satisfactory magnetic properties can be obtained via heat-treatment similar to that of an existing method. Thus, the present embodiment provides the soft magnetic powder which enables manufacture of the Fe-based nanocrystalline alloy powder having satisfactory magnetic properties without increase of manufacturing cost, not by making its crystallinity extremely close to zero but by allowing its crystallinity to be 10% or less. More specifically, according to the present embodiment, the soft magnetic powder can be stably manufactured from relatively low-cost materials by using a general atomization apparatus. In addition, manufacturing conditions such as melting temperature of material can be loosened.

As described above, the present embodiment enables obtaining the soft magnetic powder which has an amorphous phase as a main phase and contains the nano-sized aFe crystals, or has a crystal phase formed of the initial crystals, of 10 volume % or less. The smaller crystallinity is more preferable. For example, the soft magnetic powder may contain the crystal phase of 3 volume % or less. In order to make crystallinity to 3% or less, it is preferable that $a \leq 83.5$ at %, $c \leq 8.5$ at % and $d \geq 5.5$ at %.

When crystallinity is reduced to 3% or less, a molded dust core has improved green density. In detail, when crystallinity is more than 3%, the green density might be lowered. In contrast, when crystallinity is 3% or less, the green density is generally prevented from being lowered, so that permeability can be kept. In addition, when crystallinity is 3% or less, the appearance of the soft magnetic powder is generally maintained. In detail, when crystallinity is more than 3%, a soft magnetic powder after atomization might be discolored by oxidation. In contrast, when crystallinity is 3% or less, the discoloration of the soft magnetic powder is generally prevented, so that the appearance thereof can be maintained.

When the soft magnetic powder according to the present embodiment is subjected to heat-treatment under inert atmosphere such as argon gas atmosphere, two or more times of crystallizations can be observed. A temperature at which first crystallization starts is defined as "first crystallization start temperature ($T_{x1}$)", and another temperature at which second crystallization starts is defined as "second crystallization start temperature ($T_{x2}$)". In addition, $\Delta T = T_{x2} - T_{x1}$ is a temperature difference between the first crystallization start temperature ($T_{x1}$) and the second crystallization start temperature ($T_{x2}$). At the first crystallization start temperature ($T_{x1}$), an exothermic due to crystallization of bccFe nanocrystals peaks, and at the second crystallization start temperature ($T_{x2}$), another exothermic due to deposition of compounds such as FeB and FeP peaks. These crystallization start temperatures can be measured through heat analysis which is performed, for example, by using a differential scanning calorimetry (DSC) apparatus under a condition in which a temperature increase rate is about 40° C. per minute.

When $\Delta T$ is large, the heat-treatment under the predetermined heat-treatment condition can be easily performed. More specifically, the heat-treatment can be performed so that only bccFe nanocrystals are crystallized. The thus-obtained Fe-based nanocrystalline alloy powder may have superior magnetic properties. Thus, when $\Delta T$ is made large, the organization of bccFe nanocrystals in the Fe-based nanocrystalline alloy powder becomes stable, and core loss of a dust core comprising the Fe-based nanocrystalline alloy powder is reduced.

Hereafter, explanation will be made in further detail about the composition range of the soft magnetic powder according to the present embodiment.

In the soft magnetic powder according to the present embodiment, Fe element is a principal element and an essential element to provide magnetism. It is basically preferable that the Fe ratio is high for increase of saturation magnetic flux density Bs of the Fe-based nanocrystalline alloy powder and for reduction of material cost. However, as previously described, the Fe ratio according to the present embodiment is not less than 79 at % but not more than 84.5 at %. In detail, the Fe ratio is required to be 79 at % or more so that the Fe-based nanocrystalline alloy powder has desirable saturation magnetic flux density Bs and is required to be 84.5 at % or less so that the soft magnetic powder is formed to have crystallinity of 10% or less. When the Fe ratio is 79 at % or more, ΔT can be made large in addition to the aforementioned effect. The Fe ratio is further preferred to be 80 at % or more so that saturation magnetic flux density Bs is improved. However, the Fe ratio is preferred to be 83.5 at % or less so that crystallinity is reduced to 3% or less and the core loss of the dust core is reduced.

In the soft magnetic powder according to the present embodiment, Si element is an element which works to form an amorphous phase and contributes to stabilization of nanocrystals upon nano-crystallization. The Si ratio is required to be less than 6 at % (including zero) so that the core loss of the dust core is reduced. However, the Si ratio is preferred to be 2 at % or more so that saturation magnetic flux density Bs of the Fe-based nanocrystalline alloy powder is improved and is further preferred to be 3 at % or more so that ΔT is made large.

In the soft magnetic powder according to the present embodiment, B element is an essential element which works to form an amorphous phase. The B ratio is required to be not less than 4 at % but not more than 10 at % so that crystallinity of the soft magnetic powder is reduced to 10% or less and thereby the core loss of the dust core is reduced. Moreover, the B ratio is preferred to be 8.5 at % or less so that crystallinity of the soft magnetic powder is reduced to 3% or less and thereby the core loss of the dust core is further reduced.

In the soft magnetic powder according to the present embodiment, P element is an essential element which works to form an amorphous phase. As previously described, the P ratio according to the present embodiment is more than 4 at % but not more than 11 at %. In detail, when the P ratio is more than 4 at %, a molten alloy, which is used to form the soft magnetic powder, has low viscosity, so that the soft magnetic powder is easily shaped into a spherical shape which is preferable from a view point of improvement of magnetic properties of the dust core. In addition, since the melting point is lowered, capability of forming an amorphous phase can be improved, so that the Fe-based nanocrystalline alloy powder can be easily made. These effects contribute to the formation of the soft magnetic powder having crystallinity of 10% or less. The P ratio is required to be 11 at % or less so that the Fe-based nanocrystalline alloy powder has desirable saturation magnetic flux density Bs. The P ratio is preferred to be more than 5.0 at % so that rust resistivity is improved. The P ratio is further preferred to be 5.5 at % or more so that crystallinity is reduced to 3% or less and is further preferred to be 6 at % or more so that nanocrystals in the Fe-based nanocrystalline alloy powder are made extremely fine and thereby the core loss of the dust core is reduced. However, the P ratio is preferred to be 10 at % or less and is further preferred to be 8 at % or less so that saturation magnetic flux density Bs is improved.

In the soft magnetic powder according to the present embodiment, Cu element is an essential element which contributes to the nano-crystallization. As previously described, the Cu ratio according to the present embodiment is not less than 0.2 at % but less than 0.4 at %. When the Cu ratio is lowered to be not less than 0.2 at % but less than 0.4 at %, it is possible to improve capability of forming an amorphous phase while obtaining the effect of making nanocrystals in the Fe-based nanocrystalline alloy powder extremely fine. As a result, degradation of magnetic properties of the Fe-based nanocrystalline alloy powder, which might be caused by the initial crystals, can be suppressed. In detail, the Cu ratio is required to be 0.2 at % or more so that nanocrystals in the Fe-based nanocrystalline alloy powder are prevented from being enlarged and thereby the dust core has a desirable core loss, but is required to be less than 0.4 at % so that a sufficient capability of forming an amorphous phase is obtained and thereby crystallinity is reduced to 10% or less. Moreover, the Cu ratio is preferred to be 0.3 at % or more so that nanocrystals in the Fe-based nanocrystalline alloy powder are made extremely fine and thereby the core loss of the dust core is reduced. The Cu ratio is further preferred to be 0.35 at % or more so that a large amount of nanocrystals is crystallized and thereby saturation magnetic flux density Bs of the Fe-based nanocrystalline alloy powder is improved.

The soft magnetic powder according to the present embodiment may contain, in addition to Fe, P, Cu, Si and B, inevitable impurities such as Al, Ti, S, O and N contained in materials. These inevitable impurities tend to promote crystallization as crystal nuclei of the nano-sized aFe crystals (initial crystals) in the soft magnetic powder. In particular, when the ratio (content) of these inevitable impurities in the soft magnetic powder is large, crystallinity tends to be high, and variance of particle diameters of the nano-sized aFe crystals tends to be large. Therefore, the content of the inevitable impurities in the soft magnetic powder is preferred to be as small as possible.

In explanation of the present embodiment, the content of each of the principal component elements, namely Fe, P, Cu, Si and B, in the soft magnetic powder is represented by at %. In the following explanation, the content of each of the elements which are added to the principal component elements in order to improve properties of the soft magnetic powder (for example, Cr which improves rust resistivity of the soft magnetic powder and the elements such as Nb and Mo which improve amorphous nature of the soft magnetic powder) is also represented by at %. In the following explanation, the content of each of the impurity elements, which are preferred to be reduced since affecting properties of the soft magnetic powder, but which are inevitably contained because of reasons such as a manufacturing process and a material cost, is represented by mass %.

Al of the aforementioned inevitable impurities is a trace element which is contained in the soft magnetic powder when industrial materials such as Fe—P and Fe—B are used. When Al is contained in the soft magnetic powder, amorphous phase ratio of the soft magnetic powder is lowered, and soft magnetic properties are degraded. The Al content is preferred to be 0.1 mass % or less so that the amorphous phase ratio is generally prevented from being lowered. The Al content is further preferred to be 0.01 mass % or less so that the amorphous phase ratio is generally prevented from being lowered, and degradation of soft magnetic properties is suppressed.

Ti of the aforementioned inevitable impurities is a trace element which is contained in the soft magnetic powder when the industrial materials such as Fe—P and Fe—B are used. When Ti is contained in the soft magnetic powder, the amorphous phase ratio of the soft magnetic powder is lowered, and soft magnetic properties are degraded. The Ti content is preferred to be 0.1 mass % or less so that the amorphous phase ratio is generally prevented from being lowered. The Ti content is further preferred to be 0.01 mass % or less so that the amorphous phase ratio is generally prevented from being lowered, and degradation of soft magnetic properties is suppressed.

S of the aforementioned inevitable impurities is a trace element which is contained in the soft magnetic powder when the industrial materials such as Fe—P and Fe—B are used. An extremely small amount of S contained in the soft magnetic powder contributes to form the soft magnetic powder having a spherical shape. However, an excessive amount of S contained in the soft magnetic powder makes variance of particle diameters of the nano-sized aFe crystals large so that soft magnetic properties are degraded. The S content is preferred to be 0.1 mass % or less and is further preferred to be 0.05 mass % or less so that degradation of soft magnetic properties is suppressed.

O of the aforementioned inevitable impurities is a trace element which is contained in the soft magnetic powder when the industrial materials are used. In addition, O comes from water and air upon atomization and drying and is contained in the soft magnetic powder. It is known that in a case where water atomization is used, when the particle diameter decreases, the surface area of the particle increases so that the O content tends to increase. When O is contained in the soft magnetic powder, the amorphous phase ratio of the soft magnetic powder is lowered, and the molded body has low packing ratio of the soft magnetic powder and has degraded soft magnetic properties. The O content is preferred to be 1.0 mass % or less so that the amorphous phase ratio is generally prevented from being lowered. The O content is further preferred to be 0.3 mass % or less so that the molded body is generally prevented from having low packing ratio of the soft magnetic powder, and degradation of soft magnetic properties is suppressed.

N of the aforementioned inevitable impurities is a trace element which is contained in the soft magnetic powder when the industrial materials are used. In addition, N comes from air upon heat-treatment and is contained in the soft magnetic powder. When N is contained in the soft magnetic powder, the amorphous phase ratio of the soft magnetic powder is lowered, and the molded body has low packing ratio of the soft magnetic powder and has degraded soft magnetic properties. The N content is preferred to be 0.01 mass % or less and is further preferred to be 0.002 mass % or less so that the amorphous phase ratio is generally prevented from being lowered, and degradation of soft magnetic properties is suppressed.

As previously described, the composition formula of the soft magnetic powder excluding the inevitable impurities is $Fe_aSi_bB_cP_dCu_e$. Thus, the composition formula of the soft magnetic powder including the specific inevitable impurities, namely Al, Ti, S, O and N, is $(Fe_aSi_bB_cP_dCu_e)_{100-\alpha}X_\alpha$. In this composition formula, X is at least one element selected from the inevitable impurities of Al, Ti, S, O and N, and a is the ratio (mass %) of X contained in the soft magnetic powder. The preferable range (at %) of each of a, b, c, d and e is as already described.

When the soft magnetic powder contains at least one element selected from Al, Ti, S, O and N as the inevitable impurities, it is preferable that the content of Al is not more than 0.1 mass %, the content of Ti is not more than 0.1 mass %, the content of S is not more than 0.1 mass %, the content of O is not more than 1.0 mass %, and the content of N is not more than 0.01 mass %. According to these ratios, the a, which represents the ratio of the inevitable impurities X, namely Al, Ti, S, O and N, contained in the soft magnetic powder, is preferred to be 1.31 mass % or less.

When the soft magnetic powder contains at least one element selected from Al, Ti, S, O and N as the inevitable impurities, it is more preferable that the content of Al is not more than 0.01 mass %, the content of Ti is not more than 0.01 mass %, the content of S is not more than 0.05 mass %, the content of O is not more than 0.3 mass %, and the content of N is not more than 0.002 mass %. According to these ratios, the a, which represents the ratio of the inevitable impurities X, namely Al, Ti, S, O and N, contained in the soft magnetic powder, is further preferred to be 0.372 mass % or less.

In the soft magnetic powder according to the present embodiment, a part of Fe may be replaced with at least one element selected from Cr, V, Mn, Co, Ni, Zn, Nb, Zr, Hf, Mo, Ta, W, Ag, Au, Pd, K, Ca, Mg, Sn, C, Y and rare-earth elements. When this replacement is made, uniform nanocrystals are easily obtained by heat-treatment. However, replaced atomic mass according to this replacement, or Fe atomic mass to be replaced with the aforementioned elements, is required to be within a range that does not adversely affect magnetic properties, capability of forming an amorphous phase, melting condition such as melting point and material cost. More specifically, a preferable replaced atomic mass is not more than 3 at % of Fe, and a more preferable replaced atomic mass is not more than 1.5 at % of Fe.

When a part of Fe is replaced as described above, the composition formula of the soft magnetic powder is $(FeM)_aSi_bB_cP_dCu_e$ except for the inevitable impurities. When a part of Fe is replaced, the composition formula of the soft magnetic powder including the inevitable impurities X, namely Al, Ti, S, O and N, is $\{(FeM)_aSi_bB_cP_dCu_e\}_{100-\alpha}X_\alpha$ (each of a, b, c, d and e represents atomic %, while a represents mass %). M in these composition formulas is at least one element selected from Cr, V, Mn, Co, Ni, Zn, Nb, Zr, Hf, Mo, Ta, W, Ag, Au, Pd, K, Ca, Mg, Sn, C, Y and rare-earth elements. The preferable range (at %) of each of a, b, c, d and e is as already described.

Hereafter, further detailed explanation will be made about the soft magnetic powder, the Fe-based nanocrystalline alloy powder, the magnetic component and the dust core according to the present embodiment together with the forming method thereof.

The soft magnetic powder according to the present embodiment can be formed by various forming methods. For example, the soft magnetic powder may be formed by an atomization method such as a water atomization method or a gas atomization method. According to the powder forming process by the atomization method, materials are first prepared. Then, the materials are respectively weighed so as to provide the predetermined composition and are then melted so that a molten alloy is formed. Since the soft magnetic powder of the present embodiment has a low melting point, electric power consumption during this melting process can be reduced. Then, the molten alloy is discharged from a nozzle and is divided into alloy droplets by using high pressure gas or high pressure water, so that the soft magnetic powder having fine particles is formed.

In the aforementioned powder forming process, the gas which is used to divide the molten alloy may be an inert gas such as argon or nitrogen. For improvement of the cooling rate, for example, the alloy droplets formed just after the division may be brought into contact with liquid or solid to be rapidly cooled, or the alloy droplets may be further divided into more fine droplets. When the liquid is used for cooling, water or oil may be used, for example. When the solid is used for cooling, a rotating roller made of copper or a rotating plate made of aluminum may be used, for example. However, the liquid and the solid for cooling are not limited thereto, but various materials can be used.

In the aforementioned powder forming process, a particle shape and a particle diameter of the soft magnetic powder can be adjusted by changing forming conditions. According to the present embodiment, since the molten alloy has low viscosity, the soft magnetic powder is easily shaped into a spherical shape. An average particle diameter of the soft magnetic powder is preferred to be 200 μm or less and is further preferred to be 50 μm or less so that crystallinity is lowered. If the particle size distribution of the soft magnetic powder is extremely wide, undesired particle size segregation might be caused. Accordingly, the maximum particle diameter of the soft magnetic powder is preferred to be 200 μm or less.

In the aforementioned powder forming process, the initial crystals are crystallized in the soft magnetic powder which has an amorphous phase as a main phase. If compounds such as FeB and FeP are deposited as an initial precipitates, magnetic properties are extremely degraded. According to the present embodiment, deposition of compounds such as FeB and FeP in the soft magnetic powder can be reduced, so that almost all of the initial precipitates are the initial crystals of aFe (—Si) having bcc structure. In the present embodiment, the volume ratio of the initial crystals is not volume ratio of the initial crystals in each soft magnetic particle but total volume ratio of all of the initial crystals in all of the formed particles of the soft magnetic powder. Thus, the soft magnetic powder may contain a particle of a single amorphous phase and may contain a particle having crystallinity of 10% or more (of 3% or more), provided that the total volume ratio of all of the initial crystals in all of the formed particles of the soft magnetic powder is 10% or less (of 3% or less).

The aforementioned diameters of the particles of the soft magnetic powder can be measured by using a laser diffraction particle size analyzer. An average particle diameter of the soft magnetic powder can be calculated from the thus-measured particle diameters. Crystallinity and diameters of the initial precipitates can be calculated by analyzing measurement result of an X-ray diffraction (XRD) by using a whole-powder-pattern decomposition (WPPD) method. Precipitated phases such as an aFe (—Si) phase and a compound phase can be identified from peak positions of X-ray diffraction pattern. Saturation magnetization and coercivity He of the soft magnetic powder can be measured by using a vibrating sample magnetometer (VSM). Saturation magnetic flux density Bs can be calculated from density and the thus-measured saturation magnetization.

The Fe-based nanocrystalline alloy powder of the present embodiment can be made by using the soft magnetic powder of the present embodiment as a starting material. More specifically, as previously described, the heat-treatment under the predetermined heat-treatment condition is applied to the soft magnetic powder of the present embodiment, so that bccFe nanocrystals are crystallized, and thereby the Fe-based nanocrystalline alloy powder of the present embodiment can be obtained. This heat-treatment is required to be performed under a temperature of not more than the second crystallization start temperature ($T_{x2}$) so that the compound phase is not deposited. More specifically, the heat-treatment in the present embodiment is required to be performed under a temperature of not more than 550° C. Moreover, the heat-treatment is preferred to be performed under a temperature of not less than 300° C. in an inert atmosphere such as argon or nitrogen. However, the heat-treatment may be temporarily performed in an oxidizing atmosphere so that an oxidized layer is formed on the surface of the Fe-based nanocrystalline alloy powder to improve rust resistivity and insulating property. Moreover, the heat-treatment may be temporarily performed in a reducing atmosphere so that the surface condition of the Fe-based nanocrystalline alloy powder can be improved. Moreover, short-time heat-treatment under higher temperature or long-time heat-treatment under lower temperature may be performed in accordance with heat-treatment conditions such as heating rate, cooling rate and retention temperature.

According to the Fe-based nanocrystalline alloy powder of the present embodiment, if an average particle diameter of nanocrystals is more than 50 nm, magnetocrystalline anisotropy becomes high, and soft magnetic properties are degraded. If the average particle diameter of nanocrystals is more than 40 nm, soft magnetic properties are slightly degraded. Thus, the average particle diameter of nanocrystals is preferred to be 50 nm or less and is further preferred to be 40 nm or less.

According to the Fe-based nanocrystalline alloy powder of the present embodiment, if crystallinity of nanocrystals is less than 25%, saturation magnetic flux density Bs is slightly improved while magnetostriction is over 20 ppm. If crystallinity of nanocrystals is 40% or more, saturation magnetic flux density Bs is improved to 1.6 T or more while magnetostriction is lowered to 15 ppm or less. Thus, crystallinity of nanocrystals is preferred to be 25% or more and is further preferred to be 40% or more.

The average particle diameter and crystallinity of nanocrystals in the aforementioned Fe-based nanocrystalline alloy powder can be measured and estimated by using XRD similarly to the soft magnetic powder. Saturation magnetic flux density Bs and coercivity He of the Fe-based nanocrystalline alloy powder can be measured and calculated by using a VSM similarly to the soft magnetic powder.

By molding the Fe-based nanocrystalline alloy powder according to the present embodiment, magnetic components such as a magnetic sheet and a dust core can be produced. The thus-produced dust core can be used to produce magnetic components such as a transformer, an inductor, a reactor, a motor and a generator. The Fe-based nanocrystalline alloy powder of the present embodiment contains high volume ratio of highly magnetized nanocrystals formed of aFe (bccFe). In addition, its magnetocrystalline anisotropy is low because of the nano-sized aFe. In addition, its magnetostriction is reduced by mixed phase of positive magnetostriction of the amorphous phase and negative magnetostriction of the aFe phase. Thus, by using the Fe-based nanocrystalline alloy powder of the present embodiment, a dust core having superior magnetic properties such as high saturation magnetic flux density Bs and low core loss can be produced.

According to the present embodiment, instead of the Fe-based nanocrystalline alloy powder, the soft magnetic powder before heat-treatment can be used to produce magnetic components such as a magnetic sheet and a dust core. For example, the soft magnetic powder is molded in a predetermined shape and then subjected to heat-treatment under the predetermined heat-treatment condition, so that a magnetic component and a dust core can be produced. The thus-produced dust core can be used to produce magnetic components such as a transformer, an inductor, a reactor, a motor and a generator. Hereafter, explanation will be made about a magnetic core production process of the dust core by using the soft magnetic powder of the present embodiment.

In the magnetic core production process, the soft magnetic powder is first mixed with a binder having good insulating property such as resin and is granulated to form a granulated powder. When resin is used as the binder, the resin may be silicone, epoxy, phenol, melamine, polyurethane, polyimide or polyamide-imide, for example. In order to improve insulating property and binding property, materials such as phosphate, borate, chromate, oxide (silica, alumina, magnesia, etc.) or inorganic polymer (polysilane, polygermane, polystannane, polysiloxane, polysilsesquioxane, polysilazane, polyborazylene, polyphosphazen, etc.) may be used as the binder instead of or together with resin. A plurality of the binders may be used in combination. Different binders may be used to form a coating of multilayer structure comprising two or more layers. The amount of the binder is preferred to be about between 0.1 and 10 mass % in general, but is preferred to be about between 0.3 and 6 mass % in consideration of insulating property and packing ratio. However, the amount of the binder may be properly determined in consideration of a particle diameter, an applicable frequency, an usage, etc.

In the magnetic core production process, the granulated powder is then pressure-molded by using a metal die so that a green compact is obtained. Then, the green compact is heat-treated under the predetermined heat-treatment condition. In this heat-treatment, nano-crystallization and hardening of the binder are simultaneously performed, so that a dust core is obtained. In general, the aforementioned pressure-molding may be performed under a room temperature. However, when resin or coating having high heat resistance is used upon forming the granulated powder from the soft magnetic powder of the present embodiment, a dust core having extremely high density can be produced via pressure-molding within a temperature range of not more than 550° C., for example.

In the magnetic core production process, when the granulated powder is pressure-molded, a powder such as Fe, FeSi, FeSiCr, FeSiAl, FeNi and carbonyl iron powder, which is softer than the soft magnetic powder according to the present embodiment, may be mixed thereto so that packing ratio is improved and heat-production upon nano-crystallization is reduced. Moreover, any soft magnetic powder having a particle diameter different from that of the soft magnetic powder according to the present embodiment may be mixed thereto instead of or together with the aforementioned soft powder. When such powder is mixed, the mixed amount is preferred to be 50 mass % or less relative to the soft magnetic powder according to the present embodiment.

The dust core in the present embodiment may be produced by a process different from the aforementioned magnetic core production process. For example, as previously described, the dust core may be produced by using the Fe-based nanocrystalline alloy powder according to the present embodiment. In this case, a granulated powder may be formed similarly to the aforementioned magnetic core production process. The dust core can be produced by pressure-molding the granulated powder by using a metal die.

The dust core of the present embodiment which is produced as described above comprises the Fe-based nanocrystalline alloy powder of the present embodiment regardless of the production processes. Similarly, the magnetic component of the present embodiment comprises the Fe-based nanocrystalline alloy powder of the present embodiment.

Hereafter, further detailed explanation will be made about the embodiment of the present invention as referring to a plurality of examples.

Examples 1 to 5 and Comparative Examples 1 to 8

Industrial pure iron, ferrosilicon, ferrophosphorus, ferroboron and electrolytic copper were prepared as materials of the soft magnetic powders of Examples 1 to 5 and Comparative Examples 1 to 6 shown in Table 1 below. The materials were respectively weighed so as to provide the alloy compositions of Examples 1 to 5 and Comparative Examples 1 to 6 listed in Table 1 and were melted by high-frequency heat-treatment under argon atmosphere so that molten alloys were formed. Then, each molten alloy was water atomized so that alloy particles having an average particle diameter of between 32 and 48 μm (soft magnetic powder) were formed. Precipitated phase of precipitates in each soft magnetic powder was estimated by using X-ray diffraction (XRD). Meanwhile, each soft magnetic powder was subjected to heat-treatment under the heat-treatment condition shown in Table 1 by using an electric furnace under argon atmosphere. Saturation magnetic flux density Bs of each soft magnetic powder after heat-treatment (Fe-based nanocrystalline alloy powder) measured by using a vibrating sample magnetometer (VSM). In addition to the production of the Fe-based nanocrystalline alloy powders, each soft magnetic powder before heat-treatment was used to produce a dust core. In detail, each soft magnetic powder was granulated by using silicone resin of 2 mass %. Each granulated powder was molded at molding pressure of 10 ton/cm$^2$ by using a metal die having an outer diameter of 13 mm and an inner diameter of 8 mm, and the thus-molded body was hardened. Then, heat-treatment under each heat-treatment condition shown in Table 1 was applied by using an electric furnace under argon atmosphere, so that the dust cores were produced. XRD was used to measure and estimate an average particle diameter of nanocrystals in the soft magnetic powder after heat-treatment (Fe-based nanocrystalline alloy powder) contained in each dust core. An AC B—H analyzer was used to measure core loss of each dust core under an excitation condition of 20 kHz-100 mT. In addition, the dust cores of Comparative Examples 7 and 8 were made by using a soft magnetic powder made of FeSiCr and a soft magnetic powder made of amorphous Fe (FeSiB), respectively, and were measured and estimated similarly to the dust cores of Examples 1 to 5 and Comparative Examples 1 to 6. The aforementioned measurement and estimation results are shown in Table 1.

TABLE 1

| | composition | before heat-treatment precipitates | heat-treatment condition | after heat-treatment (*1) | (*2) | (*3) |
|---|---|---|---|---|---|---|
| Comparative Example 1 | $Fe_{82.42}Si_4B_{6.3}P_{6.2}Cu_{1.08}$ | αFe + com. | 400° C. × 30 min. | 1.74 | — | 1250 |
| Comparative Example 2 | $Fe_{82.65}Si_4B_{6.5}P_6Cu_{0.85}$ | αFe + com. | 400° C. × 30 min. | 1.73 | — | 1320 |
| Comparative Example 3 | $Fe_{82.89}Si_4B_{6.5}P_6Cu_{0.61}$ | αFe | 400° C. × 30 min. | 1.73 | 26 | 630 |
| Comparative Example 4 | $Fe_{83}Si_4B_{6.5}P_6Cu_{0.5}$ | αFe | 420° C. × 30 min. | 1.71 | 27 | 240 |
| Example 1 | $Fe_{83.11}Si_4B_{6.3}P_{6.2}Cu_{0.39}$ | αFe | 420° C. × 30 min. | 1.72 | 25 | 90 |
| Example 2 | $Fe_{83.04}Si_4B_{6.5}P_{6.1}Cu_{0.36}$ | αFe | 420° C. × 30 min. | 1.71 | 28 | 80 |
| Example 3 | $Fe_{83.19}Si_4B_6P_{6.5}Cu_{0.31}$ | αFe | 440° C. × 30 min. | 1.69 | 31 | 100 |
| Example 4 | $Fe_{83.21}Si_4B_{6.3}P_{6.2}Cu_{0.29}$ | αFe | 440° C. × 30 min. | 1.66 | 36 | 120 |
| Example 5 | $Fe_{83.29}Si_4B_{6.5}P_6Cu_{0.21}$ | αFe | 440° C. × 30 min. | 1.67 | 48 | 160 |
| Comparative Example 5 | $Fe_{82.39}Si_4B_{7.5}P_6Cu_{0.11}$ | αFe | 460° C. × 30 min. | 1.62 | 54 | 680 |
| Comparative Example 6 | $Fe_{82}Si_4B_8P_6Cu_0$ | amo. | 460° C. × 30 min. | 1.61 | 58 | 840 |
| Comparative Example 7 | FeSiCr | — | (*4) | 1.63 | — | 230 |
| Comparative Example 8 | amorphous Fe | — | 380° C. × 30 min. | 1.55 | — | 120 |

(*1) saturation magnetic flux density Bs (T) of Fe-based nanocrystalline alloy powder.
(*2) average particle diameter (nm) of nanocrystals in Fe-based nanocrystalline alloy powder contained in dust core.
(*3) core loss (W/cc) of dust core under 20 kHz-100 mT.
(*4) not heat-treated. listed Bs and core loss are measurement results with no heat-treatment.

As can be seen from Table 1, the soft magnetic powder of each of Comparative Examples 1 to 4 contains Cu of not less than 0.5 at % (not less than 0.4 at %), so that the dust core thereof has high core loss. Moreover, the soft magnetic powder of each of Comparative Examples 5 and 6 does not contain Cu or contains Cu of less than 0.2 at %, so that the dust core thereof has high core loss. In contrast, the soft magnetic powder of each of Examples 1 to 5 contains Cu of between 0.21 and 0.39 at %, so that the dust core thereof has superior core loss even in comparison with the dust core of Comparative Example 7. In particular, the soft magnetic powder of each of Examples 1 to 3 contains Cu of between 0.31 and 0.39 at %, so that the dust core thereof has superior core loss even in comparison with the dust core of Comparative Example 8. In addition, the soft magnetic powder after heat-treatment (Fe-based nanocrystalline alloy powder) of each of Examples 1 and 2 has high saturation magnetic flux density Bs of 1.7 T or more. As can be seen from the measurement results, the ratio of Cu contained in the soft magnetic powder is preferred to be not less than 0.2 at % but less than 0.4 at %. As can be seen from comparison between Example 5 and Comparative Example 5, an average particle diameter of nanocrystals in the Fe-based nanocrystalline alloy powder is preferred to be not more than 50 nm.

Examples 6 to 13 and Comparative Examples 9 to 14

Industrial pure iron, ferrosilicon, ferrophosphorus, ferroboron and electrolytic copper were prepared as materials of the soft magnetic powders of Examples 6 to 13 and Comparative Examples 9 to 12 shown in Tables 2 and 3 below. The materials were respectively weighed so as to provide the alloy compositions of Examples 6 to 13 and Comparative Examples 9 to 12 listed in Tables 2 and 3 and were melted by high-frequency heat-treatment under argon atmosphere so that molten alloys were formed. Then, each molten alloy was water atomized so that alloy particles (soft magnetic powder) were formed. Then, each soft magnetic powder was classified, so that the soft magnetic powders having average particle diameters shown in Table 2, respectively, were made. Precipitated phase of precipitates and crystallinity in each soft magnetic powder after classification were estimated by using XRD. Meanwhile, each soft magnetic powder after classification was subjected to heat-treatment under the heat-treatment condition shown in Table 2 by using an electric furnace under argon atmosphere. Coercivity He and saturation magnetic flux density Bs of each soft magnetic powder after heat-treatment (Fe-based nanocrystalline alloy powder) were measured by using a VSM. An average particle diameter of nanocrystals in each Fe-based nanocrystalline alloy powder was measured and estimated by using XRD. In addition, each soft magnetic powder after classification and before heat-treatment was used to produce a dust core. In detail, each soft magnetic powder was granulated by using silicone resin of 2 mass %. Each granulated powder was molded at molding pressure of 10 ton/cm$^2$ by using a metal die having an outer diameter of 13 mm and an inner diameter of 8 mm, and the thus-molded body was hardened. Then, heat-treatment under each heat-treatment condition shown in Table 2 was applied by using an electric furnace under argon atmosphere, so that the dust cores were produced. An AC B—H analyzer was used to measure core loss of each dust core under an excitation condition of 20 kHz-100 mT. The dust cores of Comparative Examples 13 and 14 were made by using a soft magnetic powder made of FeSiCr and a soft magnetic powder made of amorphous Fe (FeSiB), respectively, and were measured and estimated similarly to the dust cores of Examples 6 to 13 and Comparative Examples 9 to 12. The aforementioned measurement and estimation results are shown in Tables 2 and 3.

TABLE 2

| | | before heat-treatment | | |
|---|---|---|---|---|
| | composition | average particle diameter (μm) of soft magnetic powder | crystallinity (%) of soft magnetic powder | heat-treatment condition |
| Example 6 | $Fe_{83.04}Si_4B_{6.5}$ | 6 | 0.8 | 420° C. × |
| Example 7 | $P_{6.1}Cu_{0.36}$ | 15 | 1.4 | 30 min. |
| Example 8 | | 32 | 2.6 | |
| Example 9 | | 54 | 6.4 | |
| Comparative Example 9 | | 80 | 12.5 | |
| Comparative Example 10 | | 156 | 68 | |
| Comparative Example 11 | | 220 | 94 | |
| Example 10 | $Fe_{80.69}Si_4B_{8.0}$ | 24 | 0.2 | 450° C. × |
| Example 11 | $P_7Cu_{0.31}$ | 48 | 0.5 | 30 min. |
| Example 12 | | 78 | 1.4 | |
| Example 13 | | 140 | 4.8 | |
| Comparative Example 12 | | 260 | 64 | |
| Comparative Example 13 | FeSiCr | 35 | — | (*1) |
| Comparative Example 14 | amorphous Fe | 33 | — | 380° C. × 30 min. |

(*1) not heat-treated.

TABLE 3

| | | after heat-treatment | | | |
|---|---|---|---|---|---|
| | composition | (*1) | (*2) | (*3) | (*4) |
| Example 6 | $Fe_{83.04}Si_4B_{6.5}$ | 32 | 1.70 | 38 | 154 |
| Example 7 | $P_{6.1}Cu_{0.36}$ | 42 | 1.71 | 34 | 118 |
| Example 8 | | 64 | 1.71 | 33 | 88 |
| Example 9 | | 124 | 1.71 | 36 | 210 |
| Comparative Example 9 | | 842 | 1.70 | 44 | 640 |
| Comparative Example 10 | | 4800 | 1.73 | compound phase | 2400 |
| Comparative Example 11 | | 6200 | 1.72 | compound phase | 3200 |
| Example 10 | $Fe_{80.69}Si_4B_{8.0}$ | 65 | 1.65 | 29 | 82 |
| Example 11 | $P_7Cu_{0.31}$ | 48 | 1.66 | 31 | 78 |
| Example 12 | | 71 | 1.65 | 28 | 74 |
| Example 13 | | 92 | 1.67 | 29 | 180 |
| Comparative Example 12 | | 3400 | 1.64 | compound phase | 3300 |
| Comparative Example 13 | FeSiCr (*5) | 420 | 1.64 | — | 230 |
| Comparative Example 14 | amorphous Fe | 96 | 1.55 | — | 120 |

(*1) coercivity Hc (A/m) of Fe-based nanocrystalline alloy powder.

(*2) saturation magnetic flux density Bs (T) of Fe-based nanocrystalline alloy powder.

(*3) average particle diameter (nm) of nanocrystals in Fe-based nanocrystalline alloy powder.

(*4) core loss (W/cc) of dust core under 20 kHz-100 mT.

(*5) not heat-treated. listed Hc, Bs and core loss are measurement results with no heat-treatment.

As can be seen from Tables 2 and 3, the soft magnetic powder of each of Comparative Examples 9 to 12 has crystallinity higher than 10%. As a result, even after heat-treatment for nano-crystallization is performed, coercivity He of the soft magnetic powder after heat-treatment (Fe-based nanocrystalline alloy powder) is extremely high, and core loss of the dust core is extremely high. In particular, the Fe-based nanocrystalline alloy powder and the dust core of each of Comparative Examples 10 to 12, in which a compound phase is deposited, have extremely degraded magnetic properties. In contrast, the soft magnetic powder of each of Examples 6 to 13 has crystallinity not more than 10% and, after heat-treatment, has saturation magnetic flux density Bs not less than those of the Fe-based nanocrystalline alloy powders of Comparative Examples 13 and 14. In addition, the Fe-based nanocrystalline alloy powder and the dust core of each of Examples 6 to 13 have superior coercivity He and superior core loss, respectively, in comparison with the dust core of Comparative Example 13. In particular, the soft magnetic powder of each of Examples 6 to 8 and 10 to 12 has low crystallinity of 3% or less. Therefore, the soft magnetic powder and the dust core of each of Examples 6 to 8 and 10 to 12 have, after heat-treatment, magnetic properties superior than that of the dust core of Comparative Example 14.

Examples 14 to 21 and Comparative Examples 15 to 20

Industrial pure iron, ferrosilicon, ferrophosphorus, ferroboron and electrolytic copper were prepared as materials of the soft magnetic powders of Examples 14 to 21 and Comparative Examples 15 to 18 shown in Tables 4 and 5 below. The materials were respectively weighed so as to provide the alloy compositions of Examples 14 to 21 and Comparative Examples 15 to 18 listed in Tables 4 and 5 and were melted by high-frequency heat-treatment under argon atmosphere so that molten alloys were formed. Then, each molten alloy was water atomized so that alloy particles having an average particle diameter of between 36 and 49 μm (soft magnetic powder) were formed. Precipitated phase of precipitates in each soft magnetic powder and crystallinity of each soft magnetic powder were estimated by using XRD, and saturation magnetic flux density Bs of each soft magnetic powder was measured by using a VSM. Meanwhile, each soft magnetic powder was subjected to heat-treatment under the heat-treatment condition shown in Table 5 by using an electric furnace under argon atmosphere. Saturation magnetic flux density Bs of each soft magnetic powder after heat-treatment (Fe-based nanocrystalline alloy powder) was measured by using a VSM. In addition to the production of the Fe-based nanocrystalline alloy powders, each soft magnetic powder before heat-treatment was used to produce a dust core. In detail, each soft magnetic powder was granulated by using silicone resin of 2 mass %. Each granulated powder was molded at molding pressure of 10 ton/cm$^2$ by using a metal die having an outer diameter of 13 mm and an inner diameter of 8 mm, and the thus-molded body was hardened. Then, heat-treatment under each heat-treatment condition shown in Table 5 was applied by using an electric furnace under argon atmosphere, so that the dust cores were produced. An AC B—H analyzer was used to measure core loss of each dust core under an excitation condition of 20 kHz-100 mT. In addition, the dust cores of Comparative Examples 19 and 20 were made by using a soft magnetic powder made of FeSiCr and a soft magnetic powder made of amorphous Fe (FeSiB), respectively, and were measured and estimated similarly to the dust cores of Examples 14 to 21 and Comparative Examples 15 to 18. The aforementioned measurement and estimation results are shown in Tables 4 and 5.

TABLE 4

| | composition | before heat-treatment: crystallinity (%) of soft magnetic powder | saturation magnetic flux density Bs (T) of soft magnetic powder | precipitates |
|---|---|---|---|---|
| Comparative Example 15 | $Fe_{85.72}Si_{1.5}B_{10.5}P_2Cu_{0.28}$ | 78 | 1.78 | αFe + com. |
| Example 14 | $Fe_{84.48}Si_1B_9P_{5.2}Cu_{0.32}$ | 9 | 1.54 | αFe |
| Example 15 | $Fe_{83.62}Si_2B_{8.6}P_{5.5}Cu_{0.28}$ | 6.8 | 1.56 | αFe |
| Example 16 | $Fe_{83.16}Si_3B_7P_{6.5}Cu_{0.34}$ | 2.9 | 1.58 | αFe |
| Example 17 | $Fe_{82.52}Si_{3.5}B_{7.5}P_{6.1}Cu_{0.38}$ | 1.8 | 1.57 | αFe |
| Example 18 | $Fe_{82.61}Si_0B_8P_9Cu_{0.39}$ | 1.2 | 1.55 | αFe |
| Example 19 | $Fe_{82.23}Si_{5.3}B_8P_{4.1}Cu_{0.37}$ | 2.4 | 1.56 | αFe |
| Comparative Example 16 | $Fe_{81.79}Si_9B_6P_3Cu_{0.21}$ | 25 | 1.66 | αFe + com. |
| Example 20 | $Fe_{80.54}Si_4B_8P_{7.1}Cu_{0.36}$ | 0.4 | 1.56 | αFe |
| Example 21 | $Fe_{79.12}Si_{5.9}B_{4.1}P_{10.5}Cu_{0.38}$ | 0 | 1.58 | amo. |
| Comparative Example 17 | $Fe_{78.46}Si_{6.2}B_8P_7Cu_{0.34}$ | 0 | 1.54 | amo. |
| Comparative Example 18 | $Fe_{77.18}Si_6B_9P_{7.5}Cu_{0.32}$ | 0 | 1.52 | amo. |
| Comparative Example 19 | FeSiCr | — | — | — |
| Comparative Example 20 | amorphous Fe | — | — | — |

TABLE 5

| | composition | after heat-treatment: heat-treatment condition | saturation magnetic flux density Bs (T) of Fe-based nano-crystalline alloy powder | core loss (W/cc) of dust core |
|---|---|---|---|---|
| Comparative Example 15 | $Fe_{85.72}Si_{1.5}B_{10.5}P_2Cu_{0.28}$ | 400° C. × 30 min. | 1.83 | 2850 |
| Example 14 | $Fe_{84.48}Si_1B_9P_{5.2}Cu_{0.32}$ | 400° C. × 30 min. | 1.78 | 210 |
| Example 15 | $Fe_{83.62}Si_2B_{8.6}P_{5.5}Cu_{0.28}$ | 420° C. × 30 min. | 1.71 | 170 |
| Example 16 | $Fe_{83.16}Si_3B_7P_{6.5}Cu_{0.34}$ | 420° C. × 30 min. | 1.72 | 75 |
| Example 17 | $Fe_{82.52}Si_{3.5}B_{7.5}P_{6.1}Cu_{0.38}$ | 420° C. × 30 min. | 1.71 | 80 |
| Example 18 | $Fe_{82.61}Si_0B_8P_9Cu_{0.39}$ | 400° C. × 30 min. | 1.63 | 70 |
| Example 19 | $Fe_{82.23}Si_{5.3}B_8P_{4.1}Cu_{0.37}$ | 420° C. × 30 min. | 1.66 | 165 |
| Comparative Example 16 | $Fe_{81.79}Si_9B_6P_3Cu_{0.21}$ | 440° C. × 30 min. | 1.71 | 980 |
| Example 20 | $Fe_{80.54}Si_4B_8P_{7.1}Cu_{0.36}$ | 440° C. × 30 min. | 1.65 | 70 |
| Example 21 | $Fe_{79.12}Si_{5.9}B_{4.1}P_{10.5}Cu_{0.38}$ | 460° C. × 30 min. | 1.59 | 120 |
| Comparative Example 17 | $Fe_{78.46}Si_{6.2}B_8P_7Cu_{0.34}$ | 460° C. × 30 min. | 1.57 | 370 |
| Comparative Example 18 | $Fe_{77.18}Si_6B_9P_{7.5}Cu_{0.32}$ | 460° C. × 30 min. | 1.53 | 440 |

TABLE 5-continued

| | composition | after heat-treatment: heat-treatment condition | saturation magnetic flux density Bs (T) of Fe-based nano-crystalline alloy powder | core loss (W/cc) of dust core |
|---|---|---|---|---|
| Comparative Example 19 | FeSiCr | (*1) | 1.63 | 230 |
| Comparative Example 20 | amorphous Fe | 380° C. × 30 min. | 1.55 | 120 |

(*1) not heat-treated. listed Bs and core loss are measurement results with no heat-treatment.

As can be seen from Tables 4 and 5, the soft magnetic powder of each of Comparative Examples 15 to 18 has composition range which is out of the range of the present invention, so that the soft magnetic powders after heat-treatment (Fe-based nanocrystalline alloy powders) have low saturation magnetic flux density Bs, or the dust cores have inferior core loss even in comparison with the dust cores of Comparative Examples 19 and 20. In contrast, the soft magnetic powder of each of Examples 14 to 21 has composition range within the range of the present invention, so that magnetic properties after heat-treatment are improved when crystallinity is reduced to 10% or less, and magnetic properties after heat-treatment are further improved when crystallinity is reduced to 3% or less. As can be seen from Tables 4 and 5, in order to obtain effects of the present invention, it is preferable that the Fe ratio is not less than 79 at % but not more than 84.5 at %, the Si ratio is less than 6 at % (including zero), the B ratio is not less than 4 at % but not more than 10 at %, the P ratio is more than 4 at % but not more than 11 at % and the Cu ratio is not less than 0.2 at % but less than 0.4 at %. In particular, in order to reduce crystallinity to 3% or less, it is preferable that the Fe ratio is not more than 83.5 at %, the B ratio is not more than 8.5 at % and the P ratio is not less than 5.5 at %. In order to improve saturation magnetic flux density Bs of the Fe-based nanocrystalline alloy powder to 1.64 T or more, which is over saturation magnetic flux density Bs of Comparative Example 19, the P ratio is preferred to be not more than 8 at %.

Examples 22 to 30

Industrial pure iron, ferrosilicon, ferrophosphorus, ferroboron, electrolytic copper, ferrochrome, carbon, niobium, molybdenum, Co, Ni, Sn, Zn and Mn were prepared as materials of the soft magnetic powders of Examples 22 to 30 shown in Tables 6 and 7 below. The materials were respectively weighed so as to provide the alloy compositions of Examples 22 to 30 listed in Tables 6 and 7 and were melted by high-frequency heat-treatment under argon atmosphere so that molten alloys were formed. Then, each molten alloy was water atomized so that alloy particles having an average particle diameter of between 32 and 48 μm (soft magnetic powder) were formed. Precipitated phase of precipitates in the soft magnetic powder and crystallinity of the soft magnetic powder of each of Examples 22 to 30 were estimated by using XRD. Meanwhile, each soft magnetic powder was subjected to heat-treatment under the heat-treatment condition shown in Table 7 by using an electric furnace under argon atmosphere. Saturation magnetic flux density Bs of each soft magnetic powder after heat-treatment (Fe-based nanocrystalline alloy powder) was measured by using a VSM. In addition to the production of the Fe-based nanocrystalline alloy powders, each soft magnetic powder before heat-treatment was used to produce a dust core. In detail, each soft magnetic powder was granulated by using silicone resin of 2 mass %. Each granulated powder was molded at molding pressure of 10 ton/cm$^2$ by using a metal die having an outer diameter of 13 mm and an inner diameter of 8 mm, and the thus-molded body was hardened. Then, heat-treatment under each heat-treatment condition shown in Table 7 was applied by using an electric furnace under argon atmosphere, so that the dust cores were produced. An AC B—H analyzer was used to measure core loss of each dust core under an excitation condition of 20 kHz-100 mT. The aforementioned measurement and estimation results are shown in Tables 6 and 7.

TABLE 6

| | | before heat-treatment | |
|---|---|---|---|
| | composition | crystallinity (%) of soft magnetic powder | precipitates |
| Example 22 | $Fe_{81.47}Si_3B_5P_{9.2}Cu_{0.33}Cr_1$ | 1.9 | αFe |
| Example 23 | $Fe_{82.17}Si_3B_5P_{8.5}Cu_{0.33}C_1$ | 0 | None |
| Example 24 | $Fe_{82.17}Si_3B_7P_7Cu_{0.33}Nb_{0.5}$ | 0.6 | αFe |
| Example 25 | $Fe_{82.17}Si_3B_7P_7Cu_{0.33}Mo_{0.5}$ | 1.0 | αFe |
| Example 26 | $Fe_{81.17}Si_3B_7P_6Cu_{0.33}Co_{2.5}$ | 0 | None |
| Example 27 | $Fe_{79.67}Si_{3.5}B_7P_{7.5}Cu_{0.33}Ni_2$ | 0 | None |
| Example 28 | $Fe_{82.27}Si_4B_8P_{5.1}Cu_{0.33}Zn_{0.3}$ | 1.5 | αFe |
| Example 29 | $Fe_{82.27}Si_4B_8P_{5.1}Cu_{0.33}Sn_{0.3}$ | 1.0 | αFe |
| Example 30 | $Fe_{82.27}Si_4B_8P_{5.1}Cu_{0.33}Mn_{0.3}$ | 1.3 | αFe |

TABLE 7

| | | | after heat-treatment | |
|---|---|---|---|---|
| | composition | heat-treatment condition | saturation magnetic flux density Bs (T) of Fe-based nano-crystalline alloy powder | core loss (kW/m$^3$) of dust core |
| Example 22 | $Fe_{81.47}Si_3B_5P_{9.2}Cu_{0.33}Cr_1$ | 430° C. × 30 min. | 1.59 | 142 |
| Example 23 | $Fe_{82.17}Si_3B_5P_{8.5}Cu_{0.33}C_1$ | 420° C. × 30 min. | 1.65 | 113 |
| Example 24 | $Fe_{82.17}Si_3B_7P_7Cu_{0.33}Nb_{0.5}$ | 430° C. × 30 min. | 1.63 | 107 |
| Example 25 | $Fe_{82.17}Si_3B_7P_7Cu_{0.33}Mo_{0.5}$ | 420° C. × 30 min. | 1.62 | 110 |
| Example 26 | $Fe_{81.17}Si_3B_7P_6Cu_{0.33}Co_{2.5}$ | 430° C. × 30 min. | 1.72 | 100 |
| Example 27 | $Fe_{79.67}Si_{3.5}B_7P_{7.5}Cu_{0.33}Ni_2$ | 440° C. × 30 min. | 1.64 | 105 |
| Example 28 | $Fe_{82.27}Si_4B_8P_{5.1}Cu_{0.33}Zn_{0.3}$ | 420° C. × 30 min. | 1.65 | 140 |
| Example 29 | $Fe_{82.27}Si_4B_8P_{5.1}Cu_{0.33}Sn_{0.3}$ | 420° C. × 30 min. | 1.63 | 130 |
| Example 30 | $Fe_{82.27}Si_4B_8P_{5.1}Cu_{0.33}Mn_{0.3}$ | 420° C. × 30 min. | 1.62 | 136 |

Referring to Tables 6 and 7, in each of Examples 22 to 30, a part of Fe is replaced with one of Cr, Co, Ni, Zn, Mn, Nb, Mo, Sn and C. As shown in Table 7, according to Examples 22 to 30, the soft magnetic powders after heat-treatment (Fe-based nanocrystalline alloy powders) have saturation magnetic flux density Bs of between 1.59 and 1.72 T, and the dust cores have core loss of between 100 and 142 kW/m$^3$. As can be seen from these results, even if Fe is replaced with any of the elements, high saturation magnetic flux density of 1.54 T or more and superior core loss of 220 kW/m$^3$ or less can be obtained. Referring to Example 26, it can be seen that saturation magnetic flux density Bs is improved when Fe is replaced with Co. It also can be seen that a powder having low crystallinity can be obtained by replacing Fe with C, and superior core loss can be obtained by replacing Fe with Nb or Mo.

Examples 31 to 48

Industrial pure iron, ferrosilicon, ferrophosphorus, ferroboron, electrolytic copper, carbon, ferrochrome, Mn, Al, Ti and FeS were prepared as materials of the soft magnetic powders of Examples 31 to 48 shown in Tables 8 and 9 below. The materials were respectively weighed so as to provide the alloy compositions of Examples 31 to 48 listed in Table 8 and were melted by high-frequency heat-treatment under argon atmosphere so that molten alloys were formed. Then, each molten alloy was water atomized so that alloy particles having an average particle diameter of between 35 μm (soft magnetic powder) were formed. Precipitated phase of precipitates in the soft magnetic powder and crystallinity of the soft magnetic powder of each of Examples 31 to 48 were estimated by using XRD. Meanwhile, each soft magnetic powder was subjected to heat-treatment under the heat-treatment condition shown in Table 9 by using an electric furnace under argon atmosphere. Saturation magnetic flux density Bs of each soft magnetic powder after heat-treatment (Fe-based nanocrystalline alloy powder) was measured by using a VSM. In addition to the production of the Fe-based nanocrystalline alloy powders, each soft magnetic powder before heat-treatment was used to produce a dust core. In detail, each soft magnetic powder was granulated by using silicone resin of 2 mass %. Each granulated powder was molded at molding pressure of 10 ton/cm$^2$ by using a metal die having an outer diameter of 13 mm and an inner diameter of 8 mm, and the thus-molded body was hardened. Then, heat-treatment under each heat-treatment condition shown in Table 9 was applied by using an electric furnace under argon atmosphere, so that the dust cores were produced. An AC B—H analyzer was used to measure core loss of each dust core under an excitation condition of 20 kHz-100 mT. The aforementioned measurement and estimation results are shown in Table 9.

TABLE 8

| | composition except inevitable impurities which include trace elements listed right | included trace elements Al (mass. %) | Ti (mass. %) | S (mass. %) | O (mass. %) | N (mass. %) |
|---|---|---|---|---|---|---|
| Example 31 | $Fe_{81.52}Si_{3.6}B_8P_{6.5}Cu_{0.38}$ | 0.002 | 0.001 | 0.004 | 0.08 | 0.0008 |
| Example 32 | $Fe_{81.52}Si_{3.6}B_8P_{6.5}Cu_{0.38}$ | 0.007 | 0.010 | 0.041 | 0.12 | 0.0013 |
| Example 33 | $Fe_{81.52}Si_{3.6}B_8P_{6.5}Cu_{0.38}$ | 0.09 | 0.002 | 0.03 | 0.18 | 0.0007 |
| Example 34 | $Fe_{81.52}Si_{3.6}B_8P_{6.5}Cu_{0.38}$ | 0.15 | 0.001 | 0.002 | 0.15 | 0.0018 |
| Example 35 | $Fe_{81.52}Si_{3.6}B_8P_{6.5}Cu_{0.38}$ | 0.004 | 0.009 | 0.05 | 0.24 | 0.0005 |
| Example 36 | $Fe_{81.52}Si_{3.6}B_8P_{6.5}Cu_{0.38}$ | 0.001 | 0.08 | 0.005 | 0.20 | 0.0011 |
| Example 37 | $Fe_{81.52}Si_{3.6}B_8P_{6.5}Cu_{0.38}$ | 0.002 | 0.17 | 0.02 | 0.11 | 0.0010 |
| Example 38 | $Fe_{81.52}Si_{3.6}B_8P_{6.5}Cu_{0.38}$ | 0.002 | 0.005 | 0.04 | 0.30 | 0.0010 |
| Example 39 | $Fe_{81.52}Si_{3.6}B_8P_{6.5}Cu_{0.38}$ | 0.003 | 0.007 | 0.10 | 0.25 | 0.0009 |
| Example 40 | $Fe_{81.52}Si_{3.6}B_8P_{6.5}Cu_{0.38}$ | 0.01 | 0.01 | 0.26 | 0.13 | 0.0012 |
| Example 41 | $Fe_{81.52}Si_{3.6}B_8P_{6.5}Cu_{0.38}$ | 0.006 | 0.004 | 0.009 | 0.19 | 0.0006 |
| Example 42 | $Fe_{81.52}Si_{3.6}B_8P_{6.5}Cu_{0.38}$ | 0.004 | 0.003 | 0.01 | 0.28 | 0.0015 |
| Example 43 | $Fe_{81.52}Si_{3.6}B_8P_{6.5}Cu_{0.38}$ | 0.005 | 0.002 | 0.012 | 0.90 | 0.0012 |
| Example 44 | $Fe_{81.52}Si_{3.6}B_8P_{6.5}Cu_{0.38}$ | 0.008 | 0.001 | 0.004 | 0.15 | 0.0019 |
| Example 45 | $Fe_{81.52}Si_{3.6}B_8P_{6.5}Cu_{0.38}$ | 0.003 | 0.002 | 0.003 | 0.14 | 0.005 |
| Example 46 | $Fe_{81.52}Si_{3.6}B_8P_{6.5}Cu_{0.38}$ | 0.01 | 0.001 | 0.008 | 0.22 | 0.018 |
| Example 47 | $Fe_{81.65}Si_3B_8P_6Cu_{0.35}Cr_1$ | 0.005 | 0.003 | 0.018 | 0.12 | 0.0010 |
| Example 48 | $Fe_{83.15}Si_{1.5}B_{8.5}P_6Cu_{0.35}C_{0.5}$ | 0.001 | 0.006 | 0.004 | 0.23 | 0.0009 |

TABLE 9

| | before heat-treatment crystallinity (%) of soft magnetic powder | precipitates | heat-treatment condition | after heat-treatment saturation magnetic flux density Bs (T) of Fe-based nano-crystalline alloy powder | core loss ($kW/m^3$) of dust core |
|---|---|---|---|---|---|
| Example 31 | 0 | None | 440° C. × 30 min. | 1.66 | 80 |
| Example 32 | 0 | None | 440° C. × 30 min. | 1.66 | 85 |
| Example 33 | 3 | αFe | 440° C. × 30 min. | 1.64 | 150 |
| Example 34 | 9 | αFe | 440° C. × 30 min. | 1.63 | 196 |
| Example 35 | 1 | αFe | 440° C. × 30 min. | 1.64 | 120 |
| Example 36 | 2 | αFe | 440° C. × 30 min. | 1.63 | 140 |
| Example 37 | 10 | αFe | 440° C. × 30 min. | 1.64 | 200 |
| Example 38 | 0 | None | 440° C. × 30 min. | 1.66 | 75 |
| Example 39 | 1 | αFe | 440° C. × 30 min. | 1.66 | 98 |
| Example 40 | 4 | αFe | 440° C. × 30 min. | 1.64 | 160 |
| Example 41 | 0 | None | 440° C. × 30 min. | 1.66 | 85 |
| Example 42 | 0 | None | 440° C. × 30 min. | 1.65 | 91 |
| Example 43 | 0 | None | 440° C. × 30 min. | 1.63 | 100 |
| Example 44 | 0 | None | 440° C. × 30 min. | 1.66 | 88 |
| Example 45 | 1 | αFe | 440° C. × 30 min. | 1.65 | 98 |
| Example 46 | 1 | αFe | 440° C. × 30 min. | 1.65 | 107 |
| Example 47 | 1 | αFe | 430° C. × 30 min. | 1.63 | 110 |
| Example 48 | 2 | αFe | 420° C. × 30 min. | 1.69 | 145 |

Referring to Table 8, Examples 31 to 48 contain various amount of Al, Ti, S, O and N as trace elements. Examples 31 to 46 have compositions of Fe, Si, B, P and Cu same as one another. Referring to Table 9, each of Examples 31 to 48 has low crystallinity of 10% or less, and each of Examples 31 to 48 has good saturation magnetic flux density Bs of 1.63 T or more. Moreover, each of Examples 31 to 48 has satisfactory core loss of 220 $kW/m^3$ or less. Referring to Examples 31 to 34, as the Al content increases, crystallinity and core loss become higher, and saturation magnetic flux density Bs becomes lower. In consideration of crystallinity, saturation magnetic flux density Bs and core loss, the Al content is preferred to be not more than 0.1 mass % and is further preferred to be not more than 0.01 mass % for large reduction of core loss. Examples 31 and 35 to 37, as the Ti content increases, crystallinity and core loss become higher, and saturation magnetic flux density Bs becomes lower. In consideration of crystallinity, saturation magnetic flux density Bs and core loss, the Ti content is preferred to be not more than 0.1 mass % and is further preferred to be not more than 0.01 mass % for large reduction of core loss. Referring to Examples 31 and 38 to 40, as the S content increases, crystallinity and core loss become higher, and saturation magnetic flux density Bs becomes lower. In consideration of crystallinity, saturation magnetic flux density Bs and core loss, the S content is preferred to be not more than 0.1 mass % and is further preferred to be not more than 0.05 mass % for large reduction of core loss. Referring to Examples 41 to 43, as the O content increases, core loss becomes higher. From a view point of reduction of core loss, the O content is preferred to be not more than 1 mass % and is further preferred to be not more than 0.3 mass %. Referring to Examples 44 to 46, as the N content increases, crystallinity and core loss become higher. From a view point of reduction of crystallinity and core loss, the N content is preferred to be not more than 0.01 mass % and is further preferred to be not more than 0.002 mass %.

Examples 49 to 53

Industrial pure iron, ferrosilicon, ferrophosphorus, ferroboron and electrolytic copper were prepared as materials of the soft magnetic powders of Examples 49 to 53 shown in Tables 10 and 11 below. The materials were respectively weighed so as to provide the alloy compositions of Examples 49 to 53 listed in Tables 10 and 11 and were melted by high-frequency heat-treatment under argon atmosphere so that molten alloys were formed. Then, each molten alloy was water atomized so that alloy particles having an average particle diameter of between 40 μm (soft magnetic powder) were formed. Precipitated phase of precipitates in the soft magnetic powder and crystallinity of the soft magnetic powder of each of Examples 49 to 53 were estimated by using XRD. Meanwhile, each soft magnetic powder was subjected to heat-treatment under the heat-treatment condition shown in Table 10 by using an electric furnace under argon atmosphere. Saturation magnetic flux density Bs of each soft magnetic powder after heat-treatment (Fe-based nanocrystalline alloy powder) was measured by using a VSM. In addition to the production of the Fe-based nanocrystalline alloy powders, each soft magnetic powder before heat-treatment was used to produce a dust core. In detail, each soft magnetic powder was granulated by using silicone resin of 2 mass %. Each granulated powder was molded at molding pressure of 10 ton/cm$^2$ by using a metal die having an outer diameter of 13 mm and an inner diameter of 8 mm, and the thus-molded body was hardened. Then, heat-treatment under each heat-treatment condition shown in Table 10 was applied by using an electric furnace under argon atmosphere, so that the dust cores were produced. An AC B—H analyzer was used to measure core loss of each dust core under an excitation condition of 20 kHz-100 mT. In addition, after the obtained dust cores were subjected to a temperature and humidity controlled test so as to be aged at 60° C. and 90% RH, a corrosion condition of each dust core was visually inspected. The aforementioned measurement and estimation results are shown in Tables 10 and 11.

TABLE 10

| | | before heat-treatment | | |
|---|---|---|---|---|
| | composition | crystallinity (%) of soft magnetic powder | precipitates | heat-treatment condition |
| Example 49 | $Fe_{81.83}Si_4B_9P_{4.8}Cu_{0.37}$ | 4.0 | αFe | 420° C. × 30 min. |
| Example 50 | $Fe_{81.53}Si_4B_9P_{5.1}Cu_{0.37}$ | 3.5 | αFe | 420° C. × 30 min. |
| Example 51 | $Fe_{81.63}Si_4B_{8.5}P_{5.5}Cu_{0.37}$ | 2.4 | αFe | 420° C. × 30 min. |
| Example 52 | $Fe_{81.83}Si_4B_8P_{5.8}Cu_{0.37}$ | 1.0 | αFe | 420° C. × 30 min. |
| Example 53 | $Fe_{81.63}Si_{3.5}B_8P_{6.5}Cu_{0.37}$ | 0.5 | αFe | 420° C. × 30 min. |

TABLE 11

| | | after heat-treatment | | |
|---|---|---|---|---|
| | composition | saturation magnetic flux density Bs (T) of Fe-based nanocrystalline alloy powder | core loss (kW/m$^3$) of dust core | temperature and humidity controlled Test |
| Example 49 | $Fe_{81.83}Si_4B_9P_{4.8}Cu_{0.37}$ | 1.65 | 170 | Fair |
| Example 50 | $Fe_{81.53}Si_4B_9P_{5.1}Cu_{0.37}$ | 1.64 | 158 | Good |
| Example 51 | $Fe_{81.63}Si_4B_{8.5}P_{5.5}Cu_{0.37}$ | 1.64 | 131 | Good |
| Example 52 | $Fe_{81.83}Si_4B_8P_{5.8}Cu_{0.37}$ | 1.64 | 100 | Good |
| Example 53 | $Fe_{81.63}Si_{3.5}B_8P_{6.5}Cu_{0.37}$ | 1.63 | 80 | Excellent |

Referring to Table 11, according to Example 49, slight corrosion is found after the temperature and humidity controlled test. According to Examples 50 to 53, corrosion condition is improved. As can be seen from these results, the P ratio of the soft magnetic powder is preferred to be more than 5 at %. Moreover, the soft magnetic powder of each of Examples 49 and 50 has crystallinity higher than 3%, while the soft magnetic powder of each of Examples 51 to 53 has low crystallinity of 3% or less. As a result, the dust core of each of Examples 51 to 53 has lower core loss in comparison with the dust cores of Examples 49 and 50. As can be seen from these results, in order to reduce crystallinity of the soft magnetic powder to 3% or less, it is preferable that the Fe ratio is not more than 83.5 at %, the B ratio is not more than 8.5 at %, and the P ratio is not less than 5.5 at %. Moreover, referring to Examples 52 and 53, it can be seen that core loss of the dust core can be lowered when the P ratio of the soft magnetic powder is 6 at % or more.

The present application is based on a Japanese patent application of JP2017-012977 filed before the Japan Patent Office on Jan. 27, 2017, the content of which is incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

The invention claimed is:

1. A soft magnetic powder represented by composition formula of $Fe_aSi_bB_cP_dCu_e$ except for inevitable impurities, wherein $79 \le a \le 84.5$ at %, $0 \le b < 6$ at %, $4 \le c \le 10$ at %, $4 < d \le 11$ at %, $0.2 \le e < 0.4$ at % and $a+b+c+d+e=100$ at %, wherein:

the soft magnetic powder is configured to be used as a starting material of an Fe-based nanocrystalline alloy powder which can be formed by applying heat-treatment to the soft magnetic powder;

the soft magnetic powder has an amorphous phase as a main phase;

the soft magnetic powder, before the heat-treatment, contains a crystal phase of at least 0.2 volume % and not more than 10 volume %;

the crystal phase consists of αFe crystals;

the soft magnetic powder includes Al, Ti, S, O and N as the inevitable impurities, the content of Al is not more than 0.1 mass % and not less than 0.001 mass %, the content of Ti is not more than 0.1 mass % and not less than 0.001 mass %, the content of S is not more than 0.1 mass % and not less than 0.002 mass %, the content of 0 is not more than 1.0 mass % and not less than 0.08 mass %, and the content of N is not more than 0.01 mass % and not less than 0.0005 mass %;

e/d is at most 0.07; and due to the crystal phase contained in the soft magnetic powder, the soft magnetic powder represented by the composition formula is not suitable for forming a continuous strip.

2. The soft magnetic powder as recited in claim 1, wherein $2 \leq b < 6$ at %.

3. The soft magnetic powder as recited in claim 2, wherein $0.3 \leq e < 0.4$ at %.

4. The soft magnetic powder as recited in claim 2, wherein $5 < d \leq 11$ at %.

5. The soft magnetic powder as recited in claim 2, wherein not more than 3 at % of Fe is replaced with at least one element selected from Cr, V, Mn, Co, Ni, Zn, Nb, Zr, Hf, Mo, Ta, W, Ag, Au, Pd, K, Ca, Mg, Sn, C, Y and rare-earth elements.

6. The soft magnetic powder as recited in claim 1, wherein $0.3 \leq e < 0.4$ at %.

7. The soft magnetic powder as recited in claim 6, wherein $0.35 \leq e < 0.4$ at %.

8. The soft magnetic powder as recited in claim 7, wherein $5 < d \leq 11$ at %.

9. The soft magnetic powder as recited in claim 7, wherein not more than 3 at % of Fe is replaced with at least one element selected from Cr, V, Mn, Co, Ni, Zn, Nb, Zr, Hf, Mo, Ta, W, Ag, Au, Pd, K, Ca, Mg, Sn, C, Y and rare-earth elements.

10. The soft magnetic powder as recited in claim 6, wherein $5 < d \leq 11$ at %.

11. The soft magnetic powder as recited in claim 6, wherein not more than 3 at % of Fe is replaced with at least one element selected from Cr, V, Mn, Co, Ni, Zn, Nb, Zr, Hf, Mo, Ta, W, Ag, Au, Pd, K, Ca, Mg, Sn, C, Y and rare-earth elements.

12. The soft magnetic powder as recited in claim 1, wherein $5 < d \leq 11$ at %.

13. The soft magnetic powder as recited in claim 1, wherein not more than 3 at % of Fe is replaced with at least one element selected from Cr, V, Mn, Co, Ni, Zn, Nb, Zr, Hf, Mo, Ta, W, Ag, Au, Pd, K, Ca, Mg, Sn, C, Y and rare-earth elements.

14. The soft magnetic powder as recited in claim 1, wherein the content of Al is not more than 0.01 mass % and not less than 0.001 mass %, the content of Ti is not more than 0.01 mass % and not less than 0.001 mass %, the content of S is not more than 0.05 mass % and not less than 0.002 mass %, the content of O is not more than 0.3 mass % and not less than 0.08 mass %, and the content of N is not more than 0.002 mass % and not less than 0.0005 mass %.

15. The soft magnetic powder as recited in claim 1, wherein the soft magnetic powder contains the crystal phase of at least 0.2 volume % and not more than 3 volume %.

16. An Fe-based nanocrystalline alloy powder made by using the soft magnetic powder as recited in claim 1 as a starting material.

17. A magnetic component comprising the Fe-based nanocrystalline alloy powder as recited in claim 16.

18. A dust core comprising the Fe-based nanocrystalline alloy powder as recited in claim 16.

* * * * *